US006360738B1

(12) United States Patent
Brooks

(10) Patent No.: US 6,360,738 B1
(45) Date of Patent: Mar. 26, 2002

(54) SNOW DISPOSAL APPARATUS

(76) Inventor: Ernest E. Brooks, Rt. 1, Box 258, Matoaka, WV (US) 24736

( * ) Notice: Subject to any disclaimer, the term of this patent is extended or adjusted under 35 U.S.C. 154(b) by 0 days.

(21) Appl. No.: 09/663,120

(22) Filed: Sep. 15, 2000

Related U.S. Application Data

(60) Provisional application No. 60/154,000, filed on Sep. 15, 1999.

(51) Int. Cl.[7] ..... E01H 5/10
(52) U.S. Cl. ..... 126/343.5 R; 219/421
(58) Field of Search ..... 126/343.5 R, 343.5 A; 37/227, 228; 219/421

(56) References Cited

U.S. PATENT DOCUMENTS

| | | | | | |
|---|---|---|---|---|---|
| 553,401 | A | * | 1/1896 | Von Garnier | 126/343.5 R |
| 1,418,630 | A | * | 6/1922 | Crouse | 126/343.5 R |
| 2,471,733 | A | * | 5/1949 | Fiduccia | 126/343.5 R |
| 2,576,829 | A | * | 11/1951 | Fiduccia | 126/343.5 R |
| 2,605,760 | A | * | 8/1952 | Cayas | 126/343.5 R |
| 3,155,089 | A | | 11/1964 | Hoyt | 126/343.5 |
| 3,171,405 | A | * | 3/1965 | Miller | 126/343.5 R |
| 3,270,741 | A | | 9/1966 | Petlak | 126/343.5 |
| 3,747,587 | A | | 7/1973 | McKenzie | 126/343.5 |
| 4,353,176 | A | | 10/1982 | Hess | 37/228 |
| 4,409,957 | A | | 10/1983 | Muhammad | 126/343.5 |
| 4,506,656 | A | | 3/1985 | Baasch | 126/343.5 |
| 4,785,561 | A | | 11/1988 | Swanson | 37/197 |
| 5,235,762 | A | | 8/1993 | Brady | 37/228 |
| 5,588,231 | A | | 12/1996 | Mavrianos | 37/227 |

FOREIGN PATENT DOCUMENTS

| | | | |
|---|---|---|---|
| JP | 11-71733 A | * | 3/1999 |

* cited by examiner

*Primary Examiner*—Sara Clarke
(74) *Attorney, Agent, or Firm*—Steptoe & Johnson PLLC

(57) ABSTRACT

A snow disposal apparatus for melting snow having a receiving tank with an interior, a top portion in which snow is disposed through a top opening and a lower portion having a downward tapering shape terminating in a bottom opening, and a load plate positioned in the top portion of the receiving tank in proximity to where the top portion joins the lower portion. A means for heating is positioned within the top portion of the receiving tank below the load plate, which in the preferred embodiment is a fuel distribution manifold and a plurality of burner tubes and flame guards. In operation, the apparatus is positioned above a drain or sewer opening and the means for heating is ignited. Snow is deposited within the top portion of the receiving tank wherein the snow is melted and flows into the lower portion of the receiving tank and out of the apparatus through the bottom opening in the lower portion of the receiving tank and into the drain below.

16 Claims, 4 Drawing Sheets

SNOW DISPOSAL APPARATUS

RELATED APPLICATIONS

This application claims the benefit of U.S. patent application No. 60/154,000, filed Sep. 15, 1999.

BACKGROUND OF THE INVENTION

1. Field of the Invention

This invention relates to snow melting apparatuses, and more specifically, to a snow melting apparatus having a receiving tank for containing snow and using a plurality of burners to melt the snow, wherein the melted snow flows through a bottom opening of the apparatus.

2. Related Art

There are many areas of the world in which snow removal is a large task. The accumulation of snow in parking lots and on roads causes great hardships on people and in travel. As a result, there have been many attempts in inventing apparatuses for disposing of unwanted snow. However, each of these prior art apparatuses has several disadvantages which renders the apparatus impractical and unusable.

For example, in U.S. Pat. No. 5,235,762 to Brady, a snow melting apparatus is disclosed that requires a reserve tank of water. In operation, the apparatus uses a fan to force heat from a single burner through a central channel which then distributes the heat via a plurality of heat exchanger pipes. The apparatus also heats water in the reserve tank which is then circulated through the sides of the apparatus as a further means of heating the apparatus and melting the snow. In addition, the heated water is sprayed on top of the snow to advance the melting.

There are several disadvantages associated with using the Brady apparatus. First, the apparatus cannot be permanently stored outside because any water stored in the apparatus would freeze, thereby rendering the apparatus inoperable until thawed. Second, even if any stored water was removed when the apparatus was not being used, the apparatus would require a lot of work to start up the apparatus. For example, the user would have to haul water to the apparatus and "fill it up." This would be very cumbersome and at times, impractical. Third, the apparatus requires a fan to force heated air through the central channel. Again, if the apparatus is kept outside for extended periods of time, the fan may freeze or otherwise become unusable until maintenance is performed.

In a second apparatus, U.S. Pat. No. 4,506,656 to Baasch discloses a snow melting apparatus that requires a continues flow of water input to the apparatus wherein the preferred source of water is a fire hydrant. In operation, water is input into the tank, then a plurality of propellers agitate the water which in turn melts the snow. The input water and melted water are then output together.

There are several disadvantages with using the Baasch apparatus. First, the apparatus requires a fire hydrant or other large source of input water. This can be very inconvenient if one needs to remove snow from a location far distant from a fire hydrant, or in the alternative, if the user is required to truck a large volume of water to the apparatus. Second, the use of propellers requires a high degree of maintenance. The propellers may freeze or otherwise become locked, thereby rendering the apparatus inoperable. Third, this apparatus does not incorporate any burner type component for heating the snow. The apparatus relies on the temperature of the input water and the agitation thereof.

These prior art snow disposal apparatuses involve a combination of components resulting in a complex device requiring a high degree of set-up and maintenance. Therefore, there is a need for a straightforward, simple mechanical apparatus having minimum components that efficiently and effectively melts snow and disposes of the melted water. There is a further need for a snow disposal apparatus that can be stored outdoors and does not require a storage tank for holding the melted snow.

SUMMARY OF THE INVENTION

The present invention solves the problems associated with conventional snow disposal apparatus by disclosing an apparatus that comprises a receiving tank having a top portion with a top opening and a lower portion that tapers down to a bottom opening. The top portion has a load plate, positioned in proximity to the intersection of the top portion and the lower portion, used for holding snow within the top portion of the receiving tank. Incorporated into the top portion, under the load plate, is a means for heating the snow, which preferably comprises a plurality of burner tubes, each of which has a plurality of burners. A fuel distribution manifold is connected to all burner tubes for distributing fuel, e.g., propane, to each burner tube. A fuel source and an ignitor assembly also is connected to the distribution manifold to ignite and maintain flames along the burner tubes.

In operation, a user activates the ignitor assembly connected to the fuel distribution manifold, and the resulting flame follows the fuel distribution through the fuel distribution manifold and into the burner tubes, resulting in each burner along the length of a burner tube being lit with a flame. The heat of the flames heats the load plate and melts the snow contained in the top portion on the load plate. A flame guard is positioned above each burner tube to protect the flame of each burner from getting extinguished by melting snow. The resulting water from the melting snow falls through the load plate into the lower portion and out the bottom opening of the apparatus. Preferably, the snow disposal apparatus of the present invention is positioned over a drain or sewer whereby all melted snow flows into the drain.

As a means for improving the performance of the snow disposal apparatus, the means for heating is turned on prior to snow being disposed within the receiving tank. By preheating the apparatus, the walls of the receiving tank are preheated. Therefore, when snow is deposited into the receiving tank, the melting of the snow is enhanced such that the snow will melt faster. Furthermore, upon being deposited in the receiving tank, the snow will not stick to the walls of the receiving tank because of the fact that the walls have been preheated.

There are many advantages associated with the present invention. First, the instant snow disposal apparatus may be position over any drain, sewer or gutter to facilitate the removal of snow from a large parking lot, airport runway, private or commercial driveway, or the like. Second, the apparatus may be made to any dimension depending on the size and location of the area to be cleared of snow. Third, the apparatus is easily used and transported in that it only requires a fuel source, e.g., a propane tank. There is no water needed as an input source nor does it store the melted water between uses. In an alternative embodiment, the apparatus may be adapted to use electricity as a means for heating, thereby eliminating the need for a fuel source or tank. The user would only have to have an appropriate size electrical hook up for the apparatus. Lastly, by preheating the apparatus, the effectiveness of melting snow is improved.

BRIEF DESCRIPTION OF THE FIGURES

The present invention is described with reference to the accompanying drawings. In the drawings, like reference numbers indicate identical or functionally similar elements.

Additionally, the left-most digit(s) of a reference number identifies the drawing in which the reference number first appears.

DETAILED DESCRIPTION OF THE PREFERRED EMBODIMENTS

Figure 1:
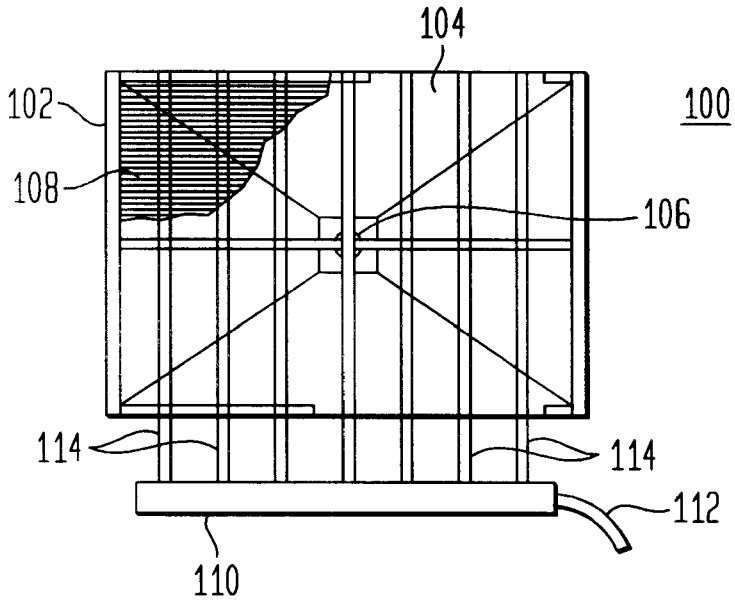
FIG. 1: A planar top view of the preferred embodiment of a snow disposal apparatus of the present invention.
Figure 2:
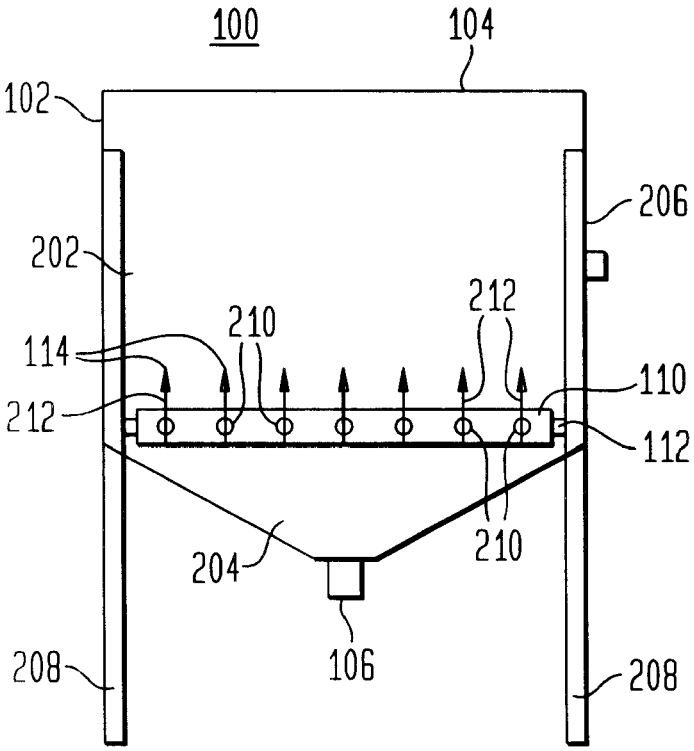
FIG. 2: A planar front view of the apparatus.
Figure 3:
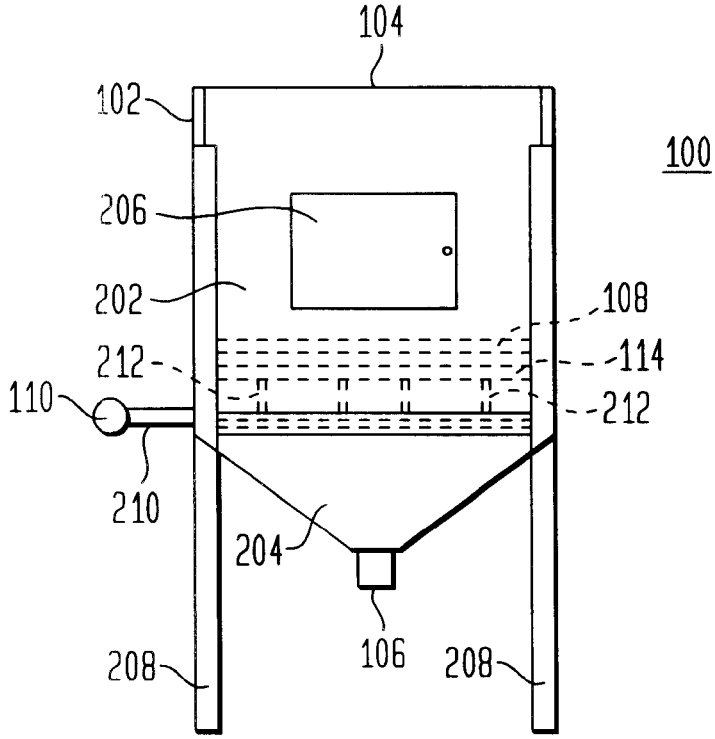
FIG. 3: A planar side view of the apparatus.
Figure 4:
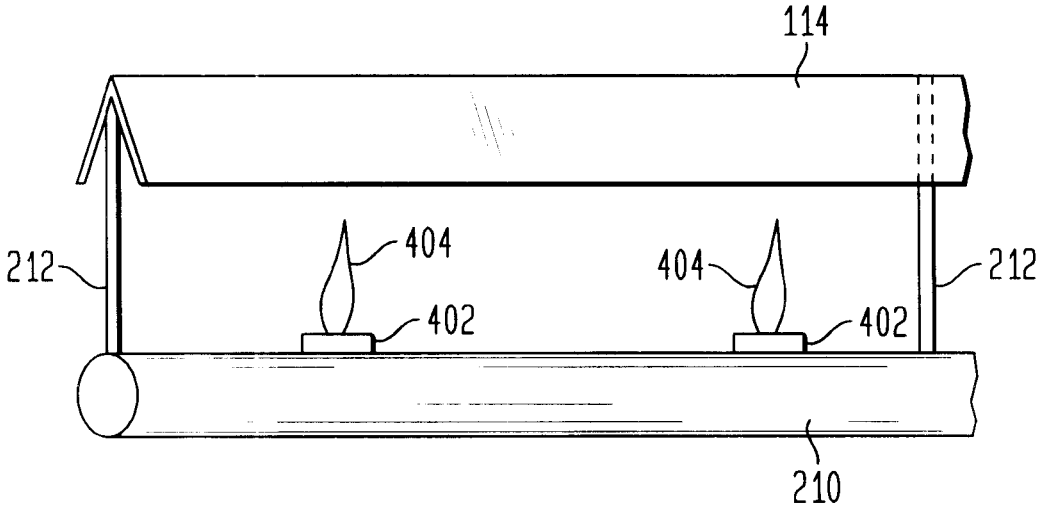
FIG. 4: A perspective view of a burner tube with a flame guard.
Figure 5:
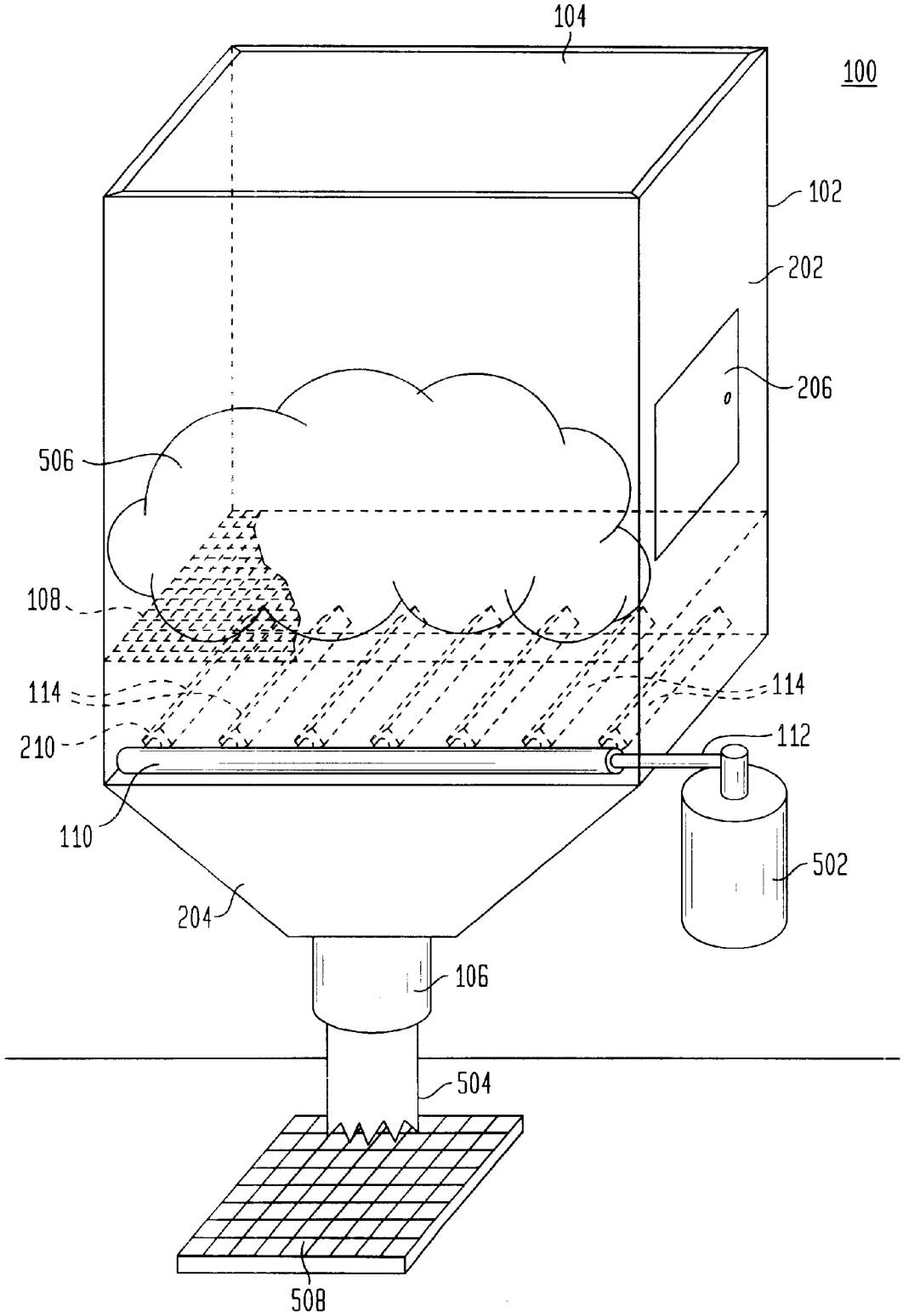
FIG. 5: A perspective view of the apparatus.
Figure 6:
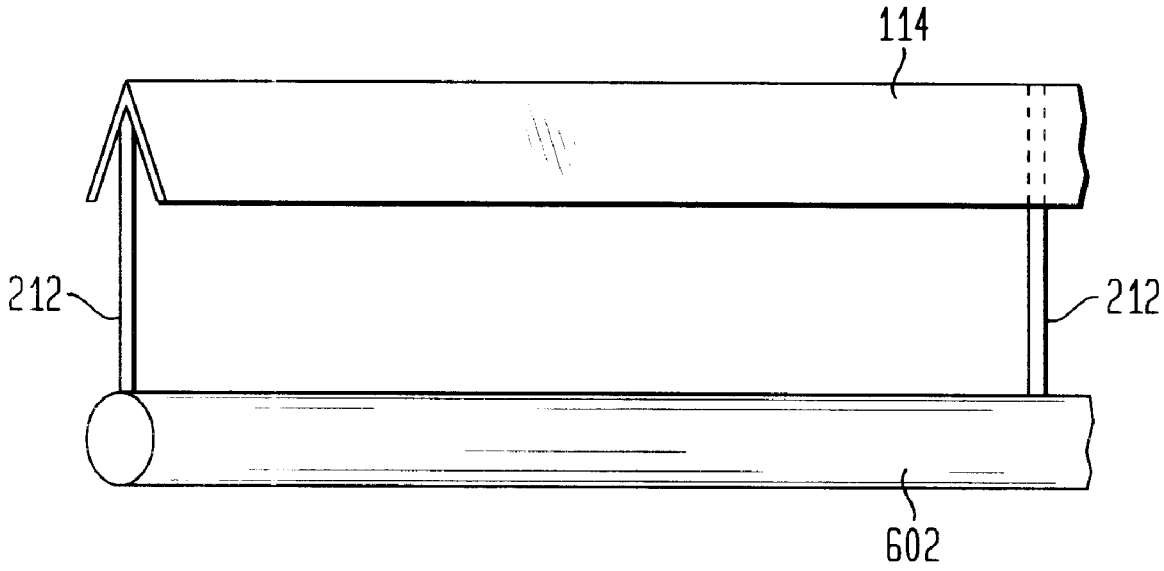
FIG. 6: A perspective view of an electric heating unit.

FIGS. 1–5 show the preferred embodiment of a snow disposal apparatus 100 of the present invention, wherein FIG. 4 is a detailed view of a burner tube 210 with a flame guard 114. The apparatus 100 comprises a receiving tank 102 having a top portion 202 in which snow 506 is disposed through a top opening 104 and a lower portion 204 being a downward tapering portion terminating in a bottom opening 106, a load plate 108 positioned in the top portion 202 of the receiving tank 102 at a point above the lower portion 204 that is used for holding and supporting the snow 506 deposited into the receiving tank 102, and a means for heating the snow 506 held on the load plate 108 wherein the means for heating is positioned below the load plate 108.

In the preferred embodiment, the means for heating comprises a distribution manifold 110 for distributing a fuel, e.g., propane, stored in a fuel source 502, e.g., a tank, to a plurality of burner tubes 210. The burner tubes 210 are positioned parallel to each other and extend the length of the receiving tank 102. Each burner tube 210 incorporates a plurality of burners 402. An ignitor assembly 112 is also connected to the distribution manifold 110 as a means for lighting the burners 402. The ignitor assembly 112 incorporates an ignitor, pilot light, and one or more fuel regulators and check valves, all of which are well known in the relevant arts. In addition, dampers and drafts, located in the receiving tank 102, are used in conjunction with the means for heating according to conventional principals. The location of the ignitor assembly 112, its components, and the dampers and drafts is described in these terms for convenience purpose only. It would be readily apparent for one of ordinary skill in the relevant art to position the ignitor assembly 112 and/or these other components at different locations on the apparatus 100.

In operation, snow is deposited within the top portion 202 of the receiving tank 102. Then, a user engages the ignitor assembly 112 resulting in a flame 404 being emitted from each burner 402 along the burner tubes 210. The heat from the flames 404 heats the load plate 108 and melts the snow 506 contained in the top portion 202 of the receiving tank 102 on the load plate 108. The melted snow 504 drips through the load plate 108 and into the lower portion 204 of the receiving tank 102 and out of the apparatus 100 through the bottom opening 106.

As a means of improving performance, a user may optionally preheat the snow disposal apparatus 100 of the present invention. In this embodiment, the ignitor assembly 112 is engaged and generates the flames 404. The flames 404 heat the apparatus 100 for about two (2) minutes prior to any snow 506 being deposited into the receiving tank 102. By preheating the apparatus 100, the walls of the receiving tank 102 are heated such that when snow 506 is deposited into the receiving tank 102, the heated walls and loading plate 108 work together to melt the snow 506 faster. Also, the snow 506 is prevented from sticking to the walls of the receiving tank 102 during the melting process. A user may preheat the apparatus 100 for any desired length of time.

In order to protect the flames 404 from being extinguished by the melting snow 506, a flame guard 114 is positioned above the flames 404. In the preferred embodiment, a flame guard 114 is an angled piece of material that extends the length of a burner tube 210. There is one flame guard 114 over each burner tube 210. A plurality of flame guard supports 212 are used to hold a flame guard 114 in place over a burner tube 210. The use of a single flame guard 114 for each burner tube 210 is for convenience only. It would be readily apparent for one of ordinary skill in the relevant art to use a plurality of flame guards 114 over each burner tube 210, e.g., one flame guard 114 per one or more burners 402 of a burner tube 210.

In addition, the use of propane as the fuel of choice is also for convenience. The apparatus 100 of the present invention would work equally as well using kerosene or natural gas. In an alternative embodiment, the apparatus 100 may be adapted to use electricity wherein the burner tubes 210 and burners 402 are replaced with electrical heating units 602.

The snow disposal apparatus 100 of the present invention also comprises a plurality of support legs 208 for supporting the apparatus 100 on the ground such that the bottom opening 106 does not touch the ground. Therefore, when placed over a drain or sewer opening 508, the melted snow 504 drains out of the bottom opening 106 and into the drain 508. In the preferred embodiment, there are four support legs 208, one located in each corner of the receiving tank 102. However, the receiving tank 102 is described in terms of a square or rectangular shape for convenience purpose only. It would be readily apparent to use a receiving tank 102 having a different shape, e.g., round. Therefore, depending on the shape of the receiving tank 102, the needed number and placement of support legs 208 may vary.

In an alternative embodiment, the receiving tank 102 has a door 206 positioned on one side of the top portion 202 of the receiving tank 102 above the load plate 108. The door 206 is used to access the interior of the receiving tank 102 for inspection or cleaning purposes. In the preferred embodiment, the door 206 either slides open or swings open via a hinge.

In the preferred embodiment, the snow disposal apparatus 100 is made of ¼ of an inch thick mild steel having non-corrosive properties, e.g., stainless steel, however this is for convenience purpose only. It would be readily apparent to one of ordinary skill to use a comparable non-corrosive material, e.g., aluminum or a composite material. In addition, the receiving tank 102 is about three and one half (3½) feet wide, four (4) feet long, and six (6) feet in height. The lower portion 204 tapers at about a 45° angle and terminates at the bottom opening 106 being about one (1) foot in width.

The burner tubes 210 are one (1) inch steel pipe having burner 402 openings about every three and one half (3½) inches, wherein the preferred embodiment has about seven (7) burner tubes 210 that are spaced about six (6) inches apart. The flame guards 114 are positioned about two (2) inches above the burner tubes 210 (measured from the top surface of a burner tube 210 to the inside top of a flame guard 114) and are made of ⅛ of an inch thick, carbon steel angle having about four (4) inch long sides such that the distance between the edges of adjacent flame guards 114 is about 1 7/16 inches. The load plate 108 is a non-corrosive metal grate positioned about two (2) inches above the top surface of the flame guards 114, wherein the load plate 108 is bolted or otherwise supported within the interior of the receiving tank 102. The support legs 206 are of an appropriate length and thickness according to the size of receiving tank 102 being supported and having a full load of snow 506.

It would be readily apparent to one of ordinary skill in the relevant arts to design and use such support legs 206.

The use of dimensions in the preferred embodiment are for convenience purpose only, wherein it would be readily apparent to one of ordinary skill in the relevant art to use alternative dimensions. For example, in an alternative embodiment, the receiving tank 102 may be about seven (7) feet wide, eight (8) feet long and ten (10) feet in height, with the top portion 202 being about eight (8) feet in height and the lower portion 204 being about two (2) feet in height, wherein the flame guards 114 are positioned about four (4) inches above the burner tubes 210 and the load plate 108 is positioned about four (4) inches above the top surface of the flame guards 114.

It is believed that the snow disposal apparatus of the present invention is described in sufficient detail such that one of ordinary skill in the relevant art can design, manufacture, and use such an apparatus. Furthermore, all dimensions and materials that are used in the preferred embodiment are for convenience purpose only. It would be readily apparent to one of ordinary skill in the relevant arts to design and build a snow disposal apparatus of the present invention using different dimensions and to use comparable non-corrosive materials.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A snow disposal apparatus for melting snow, comprising:

a receiving tank having an interior, a top portion for receiving snow through a top opening and a lower portion having a downward tapering shape terminating in a bottom opening;

a load plate positioned in said top portion of said receiving tank in proximity to where said top portion joins said lower portion; and a means for heating positioned within said receiving tank below said load plate, wherein when said means for heating melts the snow within said top portion, the melted snow falls into said lower portion and passes through said bottom opening out of the snow disposal apparatus.

2. The snow disposal apparatus according to claim 1, wherein said means for heating comprises:

a fuel source adapted for storing fuel;

an ignitor assembly in communication with said fuel source;

a fuel distribution manifold connected to said fuel source and said ignitor;

a plurality of burner tubes connected to said fuel distribution manifold, each said burner tube having a plurality of burners.

3. The snow disposal apparatus according to claim 2, further comprising a means for guarding said plurality of burners from melted snow.

4. The snow disposal apparatus according to claim 3, wherein said means for guarding comprises:

one or more flame guards; and a means for supporting said one or more flame guards over said plurality of burners.

5. The snow disposal apparatus according to claim 4, wherein said flame guards are angled steel pieces.

6. The snow disposal apparatus according to claim 4, wherein said means for supporting are a plurality of flame guard supports.

7. The snow disposal apparatus according to claim 2, wherein the fuel is selected from the group of natural gas, propane, or kerosene.

8. The snow disposal apparatus according to claim 1, wherein the snow disposal apparatus is made of a non-corrosive material.

9. The snow disposal apparatus according to claim 8, wherein said non-corrosive material is selected from the group of: stainless steel, aluminum, and composite materials.

10. The snow disposal apparatus according to claim 1, further comprising a door for accessing the interior of said receiving tank.

11. The snow disposal apparatus according to claim 1, wherein said load plate is a grate.

12. The snow disposal apparatus according to claim 1, wherein said means for heating comprises an electric heater.

13. A method for disposing of snow using a snow disposal apparatus having a receiving tank with a top portion for receiving snow through a top opening and a lower portion having a downward tapering shape terminating in a bottom opening, a load plate positioned in the top portion of the receiving tank in proximity to where the top portion joins the lower portion, and a means for heating positioned within the receiving tank below the load plate, the method comprising the steps of:

a. igniting the means for heating of the snow disposal apparatus;

b. depositing snow in the top portion of the receiving tank of the snow disposal apparatus such that the snow is held by the load plate;

c. melting the snow, thereby creating melted snow; and d. disposing of the melted snow by the melted snow falling into the lower portion of the receiving tank and passing through the bottom opening out of the snow disposal apparatus.

14. The method according to claim 13, further comprising the step of:

e. preheating the snow disposal apparatus prior to said step (b).

15. The method according to claim 14, wherein the snow disposal apparatus is preheated about 2 minutes.

16. The method according to claim 13, further comprising the step of:

e. positioning the snow disposal apparatus over a drain prior to said step (a).

* * * * *